US006530326B1

(12) United States Patent
Wendt, Jr. et al.

(10) Patent No.: US 6,530,326 B1
(45) Date of Patent: Mar. 11, 2003

(54) SINTERED TUNGSTEN LINERS FOR SHAPED CHARGES

(75) Inventors: Clarence W. Wendt, Jr., Bellville, TX (US); David Betancourt, Cypress, TX (US); John D. Loehr, Katy, TX (US); James W. Reese, Spring, TX (US)

(73) Assignee: Baker Hughes, Incorporated, Houston, TX (US)

( * ) Notice: Subject to any disclaimer, the term of this patent is extended or adjusted under 35 U.S.C. 154(b) by 0 days.

(21) Appl. No.: 09/860,117

(22) Filed: May 17, 2001

Related U.S. Application Data

(60) Provisional application No. 60/206,099, filed on May 20, 2000.

(51) Int. Cl.[7] ..... F42B 1/02; B22F 3/15

(52) U.S. Cl. ..... 102/306; 102/307; 102/476; 419/42

(58) Field of Search ..... 102/306, 307, 102/476; 419/42

(56) References Cited

U.S. PATENT DOCUMENTS

| | | | | | |
|---|---|---|---|---|---|
| 3,375,108 | A | | 3/1968 | Wyman, Sr. et al. | 102/306 |
| 3,388,663 | A | | 6/1968 | Wyman, Sr. et al. | 102/306 |
| 4,032,335 | A | * | 6/1977 | Zapf et al. | 419/42 X |
| 4,498,367 | A | | 2/1985 | Skolnick et al. | 102/306 X |
| 4,613,370 | A | | 9/1986 | Held et al. | 102/306 X |
| 4,766,813 | A | | 8/1988 | Winter et al. | 102/307 |
| 4,836,108 | A | * | 6/1989 | Kegel et al. | 102/476 X |
| 4,858,531 | A | * | 8/1989 | Lindstadt et al. | 102/476 X |
| 5,000,093 | A | * | 3/1991 | Rozner et al. | 419/42 X |
| 5,098,487 | A | * | 3/1992 | Braver et al. | 102/476 X |
| 5,119,729 | A | * | 6/1992 | Nguyen | 102/476 X |
| 5,126,105 | A | * | 6/1992 | Runkle et al. | 419/42 X |
| 5,221,808 | A | | 6/1993 | Werner et al. | 102/307 |
| 5,279,228 | A | | 1/1994 | Ayer | 102/306 |
| 5,413,048 | A | | 5/1995 | Werner et al. | 102/307 |
| 5,567,906 | A | | 10/1996 | Reese et al. | 102/307 |
| 5,597,974 | A | * | 1/1997 | Voreck, Jr. et al. | 102/307 |
| 5,656,791 | A | | 8/1997 | Reese et al. | 102/307 |
| 5,698,814 | A | * | 12/1997 | Parsons et al. | 102/307 X |
| 5,753,850 | A | * | 5/1998 | Chawla et al. | 102/476 X |
| 5,760,331 | A | * | 6/1998 | Lowden et al. | 102/506 |
| 5,814,758 | A | | 9/1998 | Leidel | 102/307 |
| 5,939,664 | A | * | 8/1999 | Kapoor | 102/307 X |
| 6,012,392 | A | * | 1/2000 | Norman et al. | 102/307 |

* cited by examiner

*Primary Examiner*—Peter A. Nelson
(74) *Attorney, Agent, or Firm*—Darryl M. Springs; Keith R. Derrington

(57) ABSTRACT

A method of producing a liner for a shaped charge comprising mixing a composition of powdered metal with plasticizers and binders to form a paste. The paste is then particulated and injected into an injection mold. The paste is molded into a molded liner shape and then chemically treated to remove plasticizers and binders from the molded liner shape. After being removed from the injection mold the molded liner shape is sintered inside of a furnace. The powdered metal composition can be comprised of a mixture of from 60% to 97% by weight of powdered heavy metal and from 40% to 3% by weight of cobalt, or the powdered metal composition can be comprised of a mixture of from 60% to 97% by weight of powdered heavy metal and from 40% to 3% of copper, the preferred heavy metal being tungsten.

24 Claims, 1 Drawing Sheet

SINTERED TUNGSTEN LINERS FOR SHAPED CHARGES

RELATED APPLICATIONS

This application claims priority from co-pending U.S. Provisional Application No. 60/206,099, filed May 19, 2000, the full disclosure of which is hereby incorporated by reference herein.

BACKGROUND OF THE INVENTION

1. Field of the Invention

The invention relates generally to the field of explosive shaped charges. More specifically, the present invention relates to a composition of matter for use as a liner in a shaped charge and a method of manufacturing a liner for a shaped charge, where the shaped charge is used for oil well perforating.

2. Description of Related Art

Shaped charges are used for the purpose, among others, of making hydraulic communication passages, called perforations, in wellbores drilled through earth formations so that predetermined zones of the earth formations can be hydraulically connected to the wellbore. Perforations are needed because wellbores are typically completed by coaxially inserting a pipe or casing into the wellbore, and the casing is retained in the wellbore by pumping cement into the annular space between the wellbore and the casing. The cemented casing is provided in the wellbore for the specific purpose of hydraulically isolating from each other the various earth formations penetrated by the wellbore.

Shaped charges known in the art for perforating wellbores are used in conjunction with a perforation gun and the shaped charges typically include a housing, a liner, and a quantity of high explosive inserted between the liner and the housing where the high explosive is usually HMX, RDX PYX, or HNS. When the high explosive is detonated, the force of the detonation collapses the liner and ejects it from one end of the charge at very high velocity in a pattern called a "jet". The jet penetrates the casing, the cement and a quantity of the formation. The quantity of the formation which may be penetrated by the jet can be estimated for a particular design shaped charge by test detonation of a similar shaped charge under standardized conditions. The test includes using a long cement "target" through which the jet partially penetrates. The depth of jet penetration through the specification target for any particular type of shaped charge relates to the depth of jet penetration of the particular perforation gun system through an earth formation.

In order to provide perforations which have efficient hydraulic communication with the formation, it is known in the art to design shaped charges in various ways to provide a jet which can penetrate a large quantity of formation, the quantity usually referred to as the "penetration depth" of the perforation. One method known in the art for increasing the penetration depth is to increase the quantity of explosive provided within the housing. A drawback to increasing the quantity of explosive is that some of the energy of the detonation is expended in directions other than the direction in which the jet is expelled from the housing. As the quantity of explosive is increased, therefore, it is possible to increase the amount of detonation-caused damage to the wellbore and to equipment used to transport the shaped charge to the depth within the wellbore at which the perforation is to be made.

The sound speed of a shaped charge liner is the theoretical maximum speed that the liner can travel and still form a coherent "jet". If the liner is collapsed at a speed that exceeds the sound speed of the liner material the resulting jet will not be coherent. A coherent jet is a jet that consists of a continuous stream of small particles. A non-coherent jet contains large particles or is a jet comprised of multiple streams of particles. The sound speed of a liner material is calculated by the following equation, sound speed=(bulk modulus/density)$^{1/2}$ (Equation 1.1). Increasing the collapse speed will in turn increase the jet tip speed. Increased the jet tip speed is desired since an increase in jet tip speed increases the kinetic energy of the jet which provides increased well bore penetration. Therefore, a liner made of a material having a higher sound speed is preferred because this provides for increased collapse speeds while maintaining jet coherency.

Accordingly, it is important to supply a detonation charge to the shaped charge liner that does not cause the shaped charge liner to exceed its sound speed. On the other hand, to maximize penetration depth, it is desired to operate shaped charge liners at close to their sound speed and to utilize shaped charge liners having maximum sound speeds. Furthermore, it is important to produce a jet stream that is coherent because the penetration depth of coherent jet streams is greater than the penetration depth of non-coherent jet streams.

As per Equation 1.1 adjusting the physical properties of the shaped charge liner materials can affect the sound speed of the resulting jet. Furthermore, the physical properties of the shaped charge liner material can be adjusted to increase the sound speed of the shaped charge liner, which in turn increases the maximum allowable speed to form a coherent jet. Knowing the sound speed of a shaped charge liner is important since theoretically a shaped charge liner will not form into a coherent jet when the jet speed well exceeds the sound speed of the shaped charge liner.

It is also known in the art to design the shape of the liner in various ways so as to maximize the penetration depth of the shaped charge for any particular quantity of explosive. Even if the shape and sound speed of the shaped charge liner is optimized, the amount of energy which can be transferred to the liner for making the perforation is necessarily limited by the quantity of explosive.

Shaped charge performance is dependent on other properties of the liner material. Density and ductility are properties that affect the shaped charge performance. Optimal performance of a shaped charge liner occurs when the jet formed by the shaped charge liner is long, coherent and highly dense. The density of the jet can be increased by utilizing a high density liner material. Jet length is determined by jet tip velocity and the jet velocity gradient. The jet velocity gradient is the rate at which the velocity of the jet changes along the length of the jet whereas the jet tip velocity is the velocity of the jet tip. The jet tip velocity and jet velocity gradient are controlled by liner material and geometry. The higher the jet tip velocity and jet velocity gradient the longer the jet.

In solid liners, a ductile material is desired since the solid liner can stretch into a longer jet before the velocity gradient causes the liner to begin fragmenting. In porous liners, it is desirable to have the liner form a long, dense, continuous stream of small particles (coherent jet). To produce a coherent jet, either from a solid liner or a porous liner; the liner material must be such that the liner does not splinter into large fragments after detonation.

The solid shaped charge liners are formed by cold working a metal into the desired shape, others are formed by adding a coating onto the cold formed liner to produce a composite liner. Information relevant to cold worked liners is addressed in Winter et al., U.S. Pat. No. 4,766,813, Ayer U.S. Pat. No. 5,279,228, and Skolnick et al., U.S. Pat. No. 4,498,367. However, solid liners suffer from the disadvantage of allowing "carrots" to form and become lodged in the resulting perforation—which reduces the hydrocarbon flow from the producing zone into the wellbore. Carrots are sections of the shaped charge liner that form into solid slugs after the liner has been detonated and do not become part of the shaped charge jet. Instead, the carrots can take on an oval shape, travel at a velocity that is lower than the shaped charge jet velocity and thus trail the shaped charge jet.

Porous liners are formed by compressing powdered metal into a substantially conically shaped rigid body. Typically, the porous liners that have been formed by compressing powdered metals have utilized a composite of two or more different metals, where at least one of the powdered metals is a heavy or higher density metal, and at least one of the powdered metals acts as a binder or matrix to bind the heavy or higher density metal. Examples of heavy or higher density metals used in the past to form liners for shaped charges have included tungsten, hafnium, copper, or bismuth. Typically the binders or matrix metals used comprise powdered lead, however powdered bismuth has been used as a binder or matrix metal. While lead and bismuth are more typically used as the binder or matrix material for the powdered metal binder, other metals having high ductility and malleability can be used for the binder or matrix metal. Other metals which have high ductility and malleability and are suitable for use as a binder or matrix metal comprise zinc, tin, uranium, silver, gold, antimony, cobalt, copper, zinc alloys, tin alloys, nickel, and palladium. Information relevant to shaped charge liners formed with powdered metals is addressed in Werner et al., U.S. Pat. No. 5,221,808, Werner et al., U.S. Pat. No. 5,413,048, Leidel, U.S. Pat. No. 5,814,758, Held et al. U.S. Pat. No. 4,613,370, Reese et al., U.S. Pat. No. 5,656,791, and Reese et al., U.S. Pat. No. 5,567,906.

Each one of the aforementioned references relating to powdered metal liners suffer from the disadvantages of non-uniform liner density, limited liner geometries, non-repeatability of liner characteristics, liner creep, and/or a high percentage of binder material in the material mix. Liner creep involves the shaped charge liner slightly expanding after the shaped charge has been assembled and stored. Even slight expansions of the shaped charge liner reduce shaped charge effectiveness and repeatability.

Most of the porous shaped charge liners currently are fabricated by pressing a powdered metal mixture with a rotating ram. This process limits the shaped charge liners into a conical or frusto-conical geometry. It is believed that liners having different geometries, such as flared openings like the bell of a trumpet, can provide higher jet tip velocities and longer jets. However, the rotating ram assembly is incapable of producing liners where the curve of the liner side has a small radius.

Further, the rotation time and pressure exerted by the rotating ram varies with each successive liner manufactured. As such, each shaped charge liners produced has different physical properties than the next or previously manufactured shaped charge liner. Therefore, the performance of the shaped charge liners cannot be accurately predicted and operational results are difficult to reproduce. The rotating ram also produces liners having densities that are not uniform throughout the liner. A liner that has a non-uniform density will not form as coherent a jet as a liner having a uniform density.

The binder or matrix material typically has a lower density than the heavy metal component. Accordingly the overall density of the shaped charge liner is reduced when a significant percentage (i.e. 30% or more) of the shaped charge liner is comprised of the binder or matrix material. Reducing the overall density of the shaped charge liner reduces the penetration depth produced by the particular shaped charge.

Therefore, it is desired to produce shaped charge liners that have a uniform density, have varied geometric shapes, have an improved overall density, have a high sound speed, have repeatable operating results, and are not subject to creep.

BRIEF SUMMARY OF THE INVENTION

A method is disclosed of producing a liner for a shaped charge comprising mixing a composition of powdered metal with plasticizers and binders to form a paste. The paste is then particulated and injected into a mold where the particles are compressed into a molded liner shape. Possible liner shapes include conical, bi-conical, tulip, hemispherical, circumferential, linear, and trumpet. After being removed from the mold, the molded linear shape is then chemically treated to remove plasticizers and binders from the molded liner shape. Following this, the molded liner shape is introduced into a furnace where it is heated to a temperature sufficient to sinter the metal particles to form the liner. In the process of sintering, any remaining organic materials are removed. The powdered metal composition of this invention is comprised of a mixture of a heavy metal powder and a metal binder. The preferred powdered heavy metal is tungsten and the preferred metal binder is either copper or cobalt. When the binder is copper, the mixture comprises from 60% to 97% by weight of heavy metal powder and from 40% to 3% by weight of copper. When the binder is cobalt, the mixture comprises from 60% to 97% by weight of heavy metal binder and from 40% to 3% by weight of cobalt.

Further disclosed is a shaped charge comprising a housing, a quantity of explosive inserted into the housing and a liner inserted into the housing. The liner is installed so that the quantity of explosive is positioned between the liner and the housing. The liner is formed from a mixture of powdered a powdered heavy metal and powdered metal binder. The metal binder consists of either copper or cobalt. When the binder is copper the mixture comprises from 60% to 97% by weight of powdered heavy metal and from 40% to 3% by weight of copper, when the binder is cobalt the mixture comprises from 60% to 97% by weight of powdered heavy metal and from 40% to 3% by weight of cobalt. The liner is formed by injection molding and sintering the mixture.

DETAILED DESCRIPTION OF THE INVENTION

Figure 1:
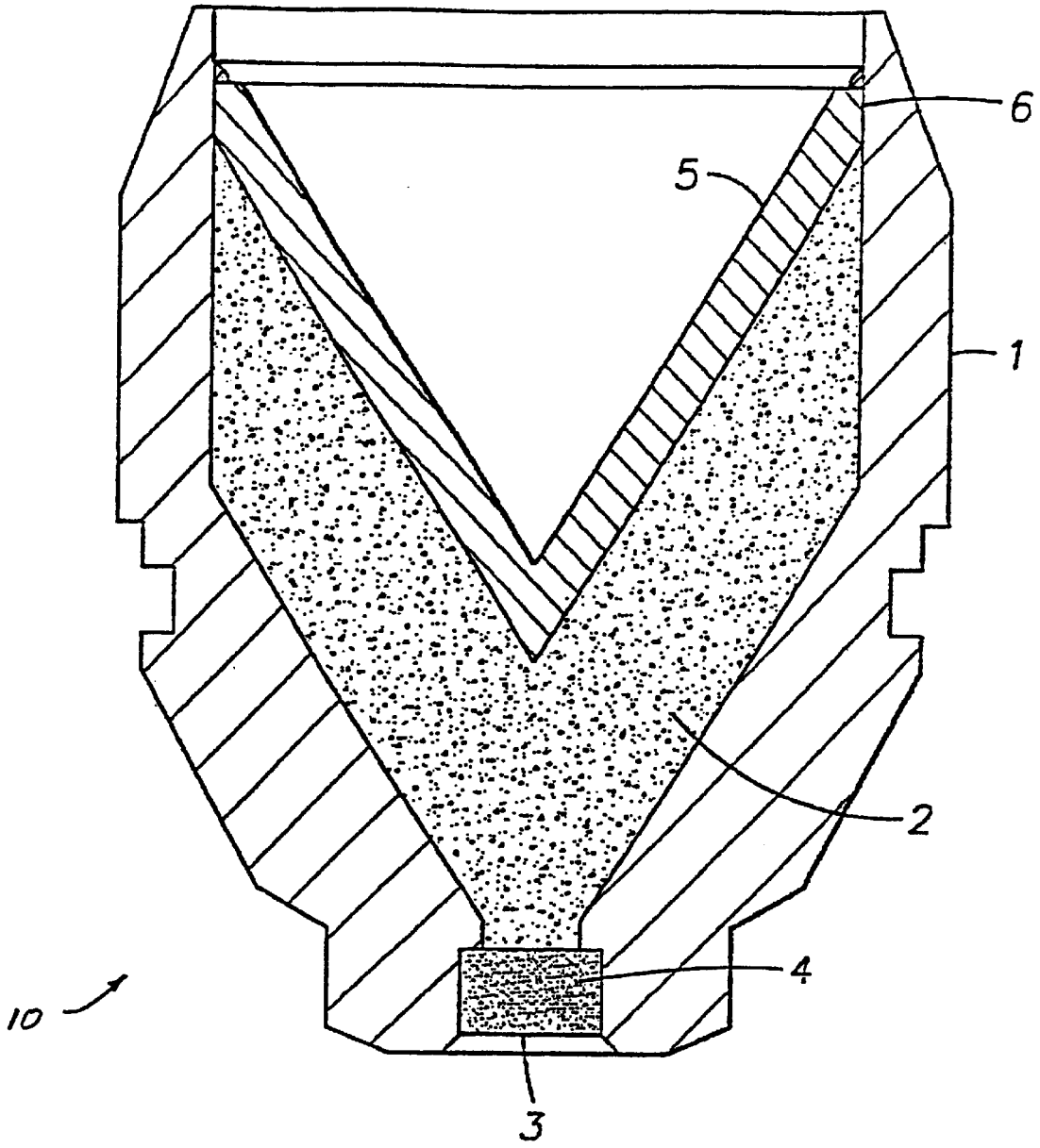
FIG. 1 depicts a cross-sectional view of a shaped charge with a liner according to the present invention.

With reference to the drawing herein, a shaped charge 10 according to the invention is shown in FIG. 1. The shaped charge 10 typically includes a generally cylindrically shaped housing 1, which can be formed from steel, ceramic or other material known in the art. A quantity of explosive powder, shown generally at 2, is inserted into the interior of the housing 1. The explosive 2 can be of a composition known in the art. Explosives known in the art for use in shaped charges include compositions sold under trade designations HMX, HNS, RDX, PYX and TNAZ. A recess 4 formed at the bottom of the housing 1 can contain a booster explosive (not shown) such as pure RDX. The booster explosive, as is understood by those skilled in the art, provides efficient transfer to the explosive 2 of a detonating signal provided by a detonating cord (not shown) which is typically placed in contact with the exterior of the recess 4. The recess 4 can be externally covered with a seal, shown generally at 3.

A liner, shown at 5, is typically inserted on to the explosive 2 far enough into the housing 1 so that the explosive 2 substantially fills the volume between the housing 1 and the liner 5. The liner 5 in the present invention is typically made from a mixture of powdered metals which is injection molded and then sintered into the desired shape. The liner body is typically open at the base and is hollow. Possible liner shapes include conical (which includes frusto-conical), bi-conical, tulip, hemispherical, circumferential, linear, and trumpet.

As is understood by those skilled in the art, when the explosive 2 is detonated, either directly by signal transfer from the detonating cord (not shown) or transfer through the booster explosive (not shown), the force of the detonation collapses the liner 5 and causes the liner 5 to be formed into a jet, once formed the jet is ejected from the housing 1 at very high velocity.

It is one of the novel features of the present invention that the shaped charge liners are fabricated by a process that involves the steps of injection molding and sintering the powdered metal mixture to produce the shaped charge liner. The powdered metal mixture comprises powdered heavy metal mixed with a binder. The preferred powdered heavy metal is tungsten. While the binder can be selected from the group consisting of lead, bismuth, zinc, tin, uranium, silver, gold, antimony, cobalt, zinc alloys, tin alloys, nickel, and palladium; the preferred binders for the present invention are cobalt or copper. Another novel feature of the present invention is that the powdered metal mixture ratio ranges from 60% to 97% powdered heavy metal and from 40% to 3% cobalt or 40% to 3% of copper. The preferred mix of the powdered heavy metal and cobalt mixture is 90% to 94% powdered heavy metal and 10% to 6% cobalt. The preferred mix of the powdered heavy metal and copper mixture is 85% powdered heavy metal and 15% copper.

The powdered metal mixture is first mixed with plasticizers and binders to produce a powdered metal paste that consists of pasty clumps of material that are 2 to 3 inches in length. The powdered metal clumps are then particulated into smaller particles of about 1 cm in length. While the preferred method of particulation occurs inside of a particulating machine that transforms the powdered metal clumps into smaller particles, particulation can be carried out by any appropriate method known in the art. After being particulated, the paste is injected into a mold where it is formed by pressure into the desired liner shape. Once molded the liner is removed from the mold and chemically treated to remove most of the plasticizers and binders. The shaped liner is then placed into a furnace where it is heated at temperature below the melting point of the powdered metal mixture, but at a high enough temperature to remove the remaining plasticizers and binders. Since the sintering process removes mass (the plasticizers and binders) from the liner material, the liner will shrink in size during sintering. Once the liner has reached the desired dimension the liner is removed from the furnace. This process is known as sintering, and as is appreciated by skilled artisans, the sintering time and furnace temperature will vary depending on the liner size desired and the amount of plasticizers and binders remaining in the material. However, without undue experimentation, one skilled in the art will know the temperature and the time during which the liner has reached the desired dimensions.

In fabricating the shaped charge, the liner 5 can be retained in the housing 1 by application of adhesive, shown at 6. The adhesive 6 enables the shaped charge 10 to withstand the shock and vibration typically encountered during handling and transportation without movement of the liner 5 or the explosive 2 within the housing 1. It is to be understood that the adhesive 6 is only used for retaining the liner 5 in position within the housing 1 and is not to be construed as a limitation on the invention.

The present invention described herein, therefore, is well adapted to carry out the objects and attain the ends and advantages mentioned, as well as others inherent therein. While a presently preferred embodiment of the invention has been given for purposes of disclosure, numerous changes in the details of procedures for accomplishing the desired results. For example, binders selected from the group consisting of lead, bismuth, zinc, tin, uranium, silver, gold, antimony, zinc alloys, tin alloys, nickel, and palladium can be implemented. These and other similar modifications will readily suggest themselves to those skilled in the art, and are intended to be encompassed within the spirit of the present invention disclosed herein and the scope of the appended claims.

What is claimed is:

1. A liner for a shaped charge for perforating well formations comprising:

a mixture of powdered heavy metal and powered metal binder said liner formed into a liner shape by injection molding and then sintering.

2. The liner for a shaped charge of claim 1, wherein said powdered heavy metal is comprised of tungsten, and said powdered metal binder is comprised of cobalt.

3. The liner for a shaped charge of claim 1, wherein said powdered heavy metal is comprised of tungsten, and said powdered metal binder is comprised of copper.

4. The liner for a shaped charge of claim 2, wherein said tungsten comprises from 60% to 97% by weight of said mixture and wherein said cobalt comprises from 40% to 3% by weight of said mixture.

5. The liner for a shaped charge of claim 3, wherein said tungsten comprises from 60% to 97% by weight of said mixture and wherein said copper comprises from 40% to 3% by weight of said mixture.

6. The liner for a shaped charge of claim 2, wherein said tungsten comprises from 90% to 94% by weight of said mixture and wherein said cobalt comprises from 10% to 6% by weight of said mixture.

7. The liner for a shaped charge of claim 3, wherein said tungsten comprises 85% by weight of said mixture and wherein said copper comprises 15% by weight of said mixture.

8. The liner for a shaped charge of claim 1, wherein said liner shape is chosen from the group consisting of conical, bi-conical, tulip, hemispherical, circumferential, linear, and trumpet.

9. A shaped charge comprising:

a housing;

a quantity of explosive inserted into said housing; and a liner inserted into said housing so that said quantity of explosive is positioned between said liner and said housing, said liner formed into a liner shape by injection molding and then sintering said mixture.

10. The liner for a shaped charge of claim 9, wherein said powdered heavy metal is comprised of tungsten, and said powdered metal binder is comprised of cobalt.

11. The liner for a shaped charge of claim 9, wherein said powdered heavy metal is comprised of tungsten, and said powdered metal binder is comprised of copper.

12. The liner for a shaped charge of claim 10, wherein said tungsten comprises from 60% to 97% by weight of said mixture and wherein said cobalt comprises from 40% to 3% by weight of said mixture.

13. The liner for a shaped charge of claim 11, wherein said tungsten comprises from 60% to 97% by weight of said mixture and wherein said copper comprises from 40% to 3% by weight of said mixture.

14. The liner for a shaped charge of claim 10, wherein said tungsten comprises from 90% to 94% by weight of said mixture and wherein said cobalt comprises from 10% to 6% by weight of said mixture.

15. The liner for a shaped charge of claim 11, wherein said tungsten comprises 85% by weight of said mixture and wherein said copper comprises 15% by weight of said mixture.

16. The liner for a shaped charge of claim 9, wherein said liner shape is chosen from the group consisting of conical, bi-conical, tulip, hemispherical, circumferential, linear, and trumpet.

17. A method of producing a liner for a shaped charge comprising the steps of:

mixing a composition of powdered metal with plasticizers and binders to form a paste;

particulating said paste;

injecting said particulated paste into an injection mold;

molding said particulated paste into a molded liner shape;

removing plasticizers and binders from said molded liner shape;

sintering said molded liner shape to produce a shaped charge liner.

18. The method of claim 17, wherein said powdered metal comprises tungsten and said binder comprises cobalt.

19. The method of claim 17, wherein said powdered metal comprises tungsten and said binder comprises copper.

20. The method of claim 18, wherein said composition comprises from 60% to 97% by weight of tungsten and 40% to 3% by weight of cobalt.

21. The method of claim 19, wherein said composition comprises from 60% to 97% by weight of tungsten and 40% to 3% by weight of copper.

22. The method of claim 18, wherein said composition comprises from 90% to 94% by weight of tungsten and 10% to 6% by weight of cobalt.

23. The method of claim 19, wherein said composition comprises 85% by weight of tungsten, and 15% by weight of copper.

24. The method of claim 17, wherein said liner shape is chosen from the group consisting of conical, bi-conical, tulip, hemispherical, circumferential, linear, and trumpet.

* * * * *